United States Patent [19]

Lepow

[11] Patent Number: 5,008,966

[45] Date of Patent: Apr. 23, 1991

[54] SHEET FOR FOAM SOFA BED

[76] Inventor: Joyce Lepow, 1321A E. Allen Rd., Tucson, Ariz. 85719

[21] Appl. No.: 490,379

[22] Filed: Mar. 8, 1990

[51] Int. Cl.[5] ..... A47G 9/04

[52] U.S. Cl. ..... 5/496; 5/497; 5/12.1

[58] Field of Search ..... 5/496, 498, 482; 12, 5/497; 297/224

[56] References Cited

U.S. PATENT DOCUMENTS

| | | | |
|---|---|---|---|
| 3,020,566 | 2/1962 | Anderson et al. | 5/497 |
| 3,066,321 | 12/1962 | Kintner | 5/482 |
| 3,906,559 | 9/1975 | Bahr | 5/496 |
| 4,040,133 | 8/1977 | Gilreath | 5/496 |

*Primary Examiner*—Alexander Grosz

*Attorney, Agent, or Firm*—Blakely, Sokoloff Taylor & Zafman

[57] ABSTRACT

A bedsheet is formed from a substantially rectangular piece of fabric. The fabric has attached to it an elastic band partially around its perimeter. The elastic band extends completely along the bottom edge of the fabric and at least partially along the two side edges of the fabric. The elastic band is stitched to the fabric to form an elasticized hem. Located at the other end of the bedsheet, on its bottom surface, are two Velcro strips. The Velcro strips attach to matching Velcro which is coupled directly to the foam mattress. The Velcro on the bedsheet couples with the matching strips on the mattress to hold the sheet firmly in place.

8 Claims, 1 Drawing Sheet

SHEET FOR FOAM SOFA BED

BACKGROUND

1. Field of The Invention

Present invention related to the field of fabrics, and more specifically to a sheet to be used in conjunction with a foam sofa bed.

2. Art Background

A popular item of furniture that is found is a sofa that has a mattress which can fold out to form a bed. One popular type of sofa bed is made from foam. Typically, this type of bed is unitary, and does not have a separate mattress for the bed portion. Instead, the seating area of the bed folds out to form the mattress Example of this type of sofa bed is illustrated in FIG. 1. Because the sofa bed is used for sleeping, it is often desirable to place a sheet on it when it is used for sleeping. It has been found that conventional bedsheets are not suitable for use with a foam sofa bed with a fold out mattress. This is because the mattress of the sofa bed is formed partially in conjunction with the sofa. With this construction, there is not a border completely surrounding the perimeter of the mattress. The typical bedsheet is therefore unable to be placed over the mattress as is normally done.

The present invention overcomes the limitation of the prior art bedsheets by providing a sheet which can attach directly to the mattress of a foam sofa bed.

SUMMARY OF THE INVENTION

The present invention provides a bedsheet which can be used for a foam sofa bed. The construction of the sheet allows it to be attached directly to the mattress of the foam sofa bed. With the present invention, a bedsheet is formed from a substantially rectangular piece of fabric. The fabric has attached to it an elastic band partially around its perimeter. The elastic band extends completely along the bottom edge of the fabric and at least partially along the two side edges of the fabric. The elastic band is stitched to the fabric to form an elasticized hem. Located at the other end of the bedsheet, on its bottom surface, are two elements of a hook end loop type fastener such as Velcro the fastener elements attach to a matching element of a hook and loop type fastener such as Velcro which is coupled directly to the foam mattress. The Velcro on the bedsheet couples with the matching strips on the mattress to hold the sheet firmly in place.

DETAILED DESCRIPTION OF THE DRAWINGS

The following specification describes a sheet to be used in conjunction with a foam sofa bed. In the following description, numerous details such as specific materials and configurations are set forth in order to provide a more complete understanding of the present invention. In other instances details which are known in the art, such as manufacturing techniques and materials, are not described in order not to obscure the present invention unnecessarily. Moreover, the present invention is described in conjunction with foam sofa beds of various sizes. It is to be understood, however, that the sofa bed is not an element of the present invention. It is included in this description only in order to provide a more thorough understanding of the present invention. The present invention consists of a sheet for a foam sofa bed.

Figure 1:
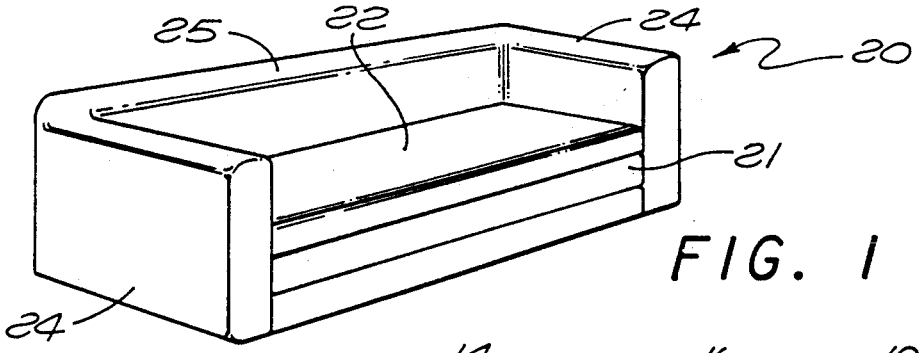
FIG. 1 is a perspective view of a foam sofa bed having the mattress folded to form a seating area.
Figure 2:
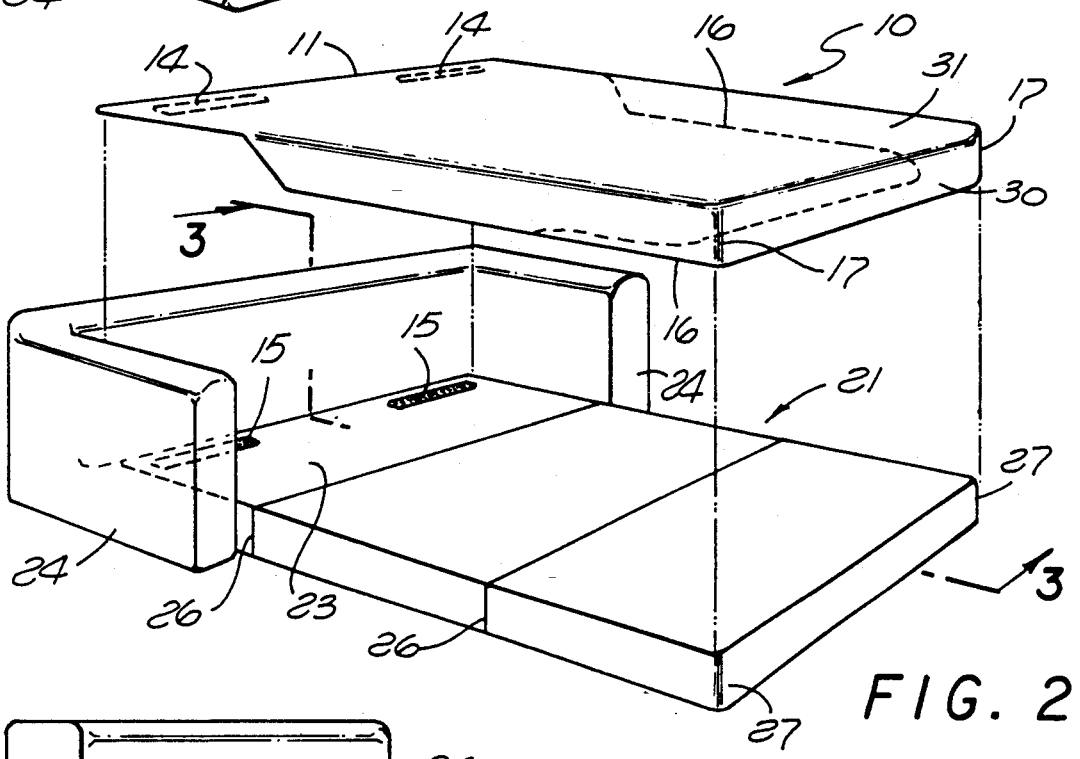
FIG. 2 is a perspective view of the sofa with the mattress unfolded and the preferred embodiment of the sheet of the present invention.

Referring first to FIG. 1, a perspective view of a foam sofa bed 20 is shown. In FIG. 1, the mattress 21 is shown in the folded position. In this position, the mattress acts as a sitting area for 22 the sofa. FIG. 2 shows the mattress in its unfolded configuration. As shown in FIG. 2, the mattress extends outward from the main body of the sofa. A portion 23 of the mattress, however, remains connected to the sofa 20. The section 23 of the mattress 21 which is coupled to the sofa is surrounded on three side edges by the arms 24 and back 25 of the sofa 20. Because the mattress 21 is coupled at these elements of the sofa, a traditional sheet is unable to be used with this type of mattress. This is because the complete outside perimeter of the mattress is not exposed. The sheet cannot be completely "tucked under" the mattress as is normally done.

With this type of sofa bed, the mattress 21 is cut in two locations 26 which results in the mattress being made up of three separate pieces. These three pieces are covered with fabric which is then sewn together, the resulting fabric cover creates a hinge between each section of mattress 21. These hinge portions allow the mattress 21 to be folded out Referring next to FIG. 3, a perspective view of the preferred embodiment of the sheet of the present invention and the manner in which it couples to the mattress 21 is shown. The sheet consists of a substantially rectangular piece o fabric 10 having top 11 and bottom 12 edges and first and second side edges 16. Near the bottom edge 12 of the fabric, fitted corners 17 are formed into the fabric 10. These corners 17 are similar to the corners which are found on typical fitted sheets. The corners 17 conform generally to the shape of the corners 27 of the mattress 21 and allow the sheet to be more easily placed on the mattress. The corners 17 are formed by removing a section of the fabric and sewing the resulting edges together.

Figure 3:
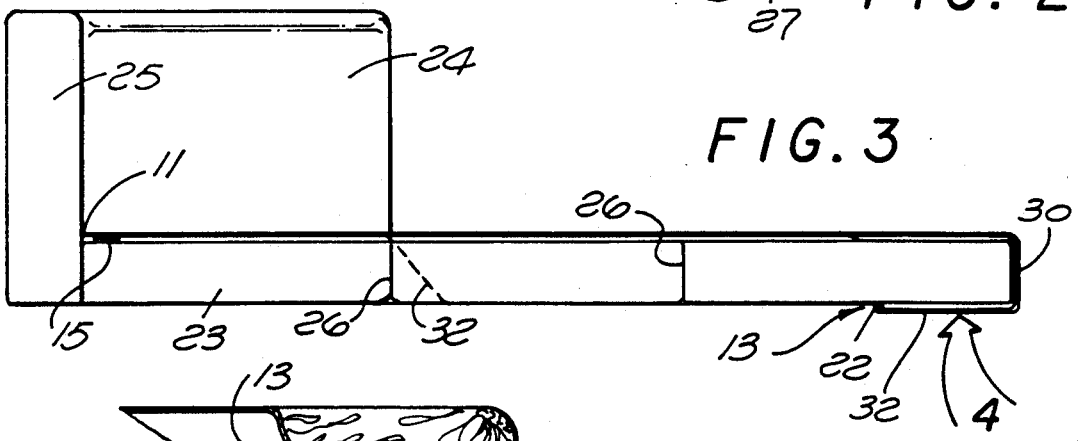
FIG. 3 is a cross-sectional view taken along the line 3—3 in FIG. 2 view showing how the sheet of the present invention couples to the foam mattress.

Also shown in FIG. 2, when the sheet is placed on the mattress 21, the bottom edge 12 folds underneath the end of the mattress. This forms an end panel 30. Also, the side edges 16 fold down along the sides of the mattress. This forms two side panels 31. The fitted corners 17 are located at the juncture of the end 30 and side 31 panels. The side panels do not extend along the full length of the fabric. Instead (as best shown in FIG. 3) they extend only along the length of the side edges of the mattress which are exposed when unfolded. At the location where the mattress section 23 is coupled to the sofa 20, an inclined edge 32 is formed in the fabric 10. In this way, the fabric 10 is able to easily fit onto the mattress. In the preferred embodiment, the bottom 30 and side 31 panels are not made from separate pieces of fabric. Instead, they are only formed when the edges of the fabric are folded down onto the mattress. However, it will be apparent to those skilled in the art that the panel can be formed by sewing additional pieces of cloth to a rectangular piece of fabric. In that case, the fabric 10 will have a shape that is substantially that as shown in FIG. 2 instead of being generally flat.

Attached to the bottom edge of the mattress is an elastic band 13. The elastic band also extends at least partially along the side edges of the fabric. The elastic band 13 is attached to the fabric 10 by stitching. This stitching forms an elastisized hem along the bottom edge 13 of the fabric. The elastic hem lets the sheet grip the mattress 21 more firmly, thereby securing the sheet in place.

A means for attaching the sheet to the portion 23 of the mattress 21 which is coupled to the sofa 20 is located near the top end 11 of the fabric. This attachment means is illustrated in FIG. 2. The attachment means used in the preferred embodiment are elements of a hook and loop type fastener such as Velcro 14. The Velcro strips are stitched to the fabric 10 near the corners at the top edge 11 of the fabric 16. Matching strips 15 are placed directly on the mattress itself. Thus, when the sheet is placed on the mattress, the top edge 11 of the sheet remains flat and the elements of a hook and loop type fastener 14 attach to the matching strips 15 on the mattress 21. This holds the sheet in place, even though the sheet is not able to completely surround the perimeter of the mattress. Although two Velcro strips are used as the attachment means in the preferred embodiment, it will be apparent to those skilled in the art that other structures can be employed to achieve the same result. For example, the two pieces of Velcro can be replaced with a single strip. Alternatively, a different attachment means, such as buttons or snaps, can be used with equal effectiveness to hold the sheet in place.

Figure 4:
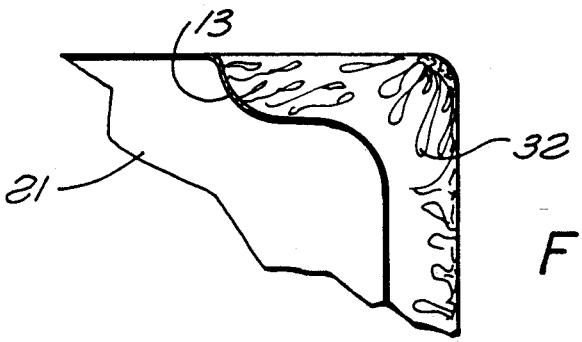
FIG. 4 is a plan view of the underside of the mattress showing the sheet coupled thereto in the location shown by the arrow in FIG. 3.

FIG. 3 is a cross-sectional view showing how the sheet of the present invention couples to the foam mattress. In this view, the sheet is placed on the mattress 21. It can be seen that the velcro strips 14 hold the top edge of the sheet to the mattress and the sheet is substantially flat in this portion. The fitted corners 17 of the sheet grip the two exposed corners 27 of the mattress. Also, as shown in FIG. 3, the bottom edge 22 of the fabric folds underneath the mattress. This forms the end panel 30 as described above, and a bottom panel 32 on the underside of the mattress. FIG. 4 is a bottom view of the mattress showing the area indicated by the arrow in FIG. 3. In FIG. 4, the bottom panel 32 is shown. In the embodiment illustrated, the bottom panel 32 extends partially along the sides of the mattress. Also shown in FIG. 4 is the elastic band 13 coupled to the bottom edge 12 of the fabric 10. The configuration of the sheet and the Velcro strips work together to hold the sheet in place.

The foregoing has described a sheet to be used in conjunction with a foam mattress. In the foregoing description, specific embodiments have been described It will be apparent to those skilled in the art that changes in these embodiment can be made without departing from the overall spirit and scope of the present invention. The foregoing description is therefore to be regarded as illustrative rather than restrictive. The scope of the present invention is limited only by the following claims.

What is claimed is:

1. A bed sheet comprising:

a first substantially rectangular piece of fabric said first piece of fabric having top and bottom edges and first and second side edges;

a second piece of fabric coupled to said first piece of fabric only along a portion of said first and second side edges and said bottom edge of said first piece of fabric, sao as to form a peripheral border, only partially surrounding the perimeter of said first piece of fabric;

an elastic member, said elastic member being coupled to an outside edge of said peripheral border;

attachment means coupled to a bottom side of said first piece of fabric and disposed substantially adjacent to said top edge of said first piece of fabric whereby the bed sheet at the area adjacent the top edge of said first sheet of fabric is substantially free of downwardly extending border elements, thereby facilitating the attachment of the attachment means on said first piece of fabric to matting attachment means on a foldable mattress that has one of its end portions and at least a part of its side edges surrounded by the back and arms of a sofa bed.

2. The device of claim 1 wherein said bed sheet further includes first and second corners formed integrally therewith, said first corner being located at a juncture of said first side and said bottom edge, said second corner being located at a juncture of said second side and said bottom edge.

3. The device of claim 1 wherein said attachment means comprises Velcro.

4. The device of claim 1 wherein said fabric is cotton.

5. A sheet for use in conjunction with a foldable mattress, said foldable mattress having one of its end portions and at least a part of both of its side edges surrounded by a back and arms of a sofa bed, thereby preventing the complete outside perimeter of the mattress from being exposed, comprising:

a substantially rectangular piece of fabric, said fabric having top and bottom edges and first and second side edges, said fabric having formed therein first and second fitted corners, said first fitted corner being located at a juncture of said first side edge and said bottom edge, said second fitted corner being located at a junction of said second side edge and said bottom edge, said fitted corners being shaped so as to conform substantially to the shape of the mattress;

an elastic member being attached to said bottom edge and at least a portion of said first and second side edges, so as to form an elasticized hem;

at least one Velcro strip attached to a bottom surface of said fabric, said Velcro strip being disposed substantially parallel to, and substantially adjacent to, said top edge the area of the sheet adjacent its top edge and side edges proximate the top edge, being substantially free of downwardly extending border areas.

6. The device of claim 5 wherein said fabric is cotton.

7. The device of claim 5 wherein there are first and second Velcro strips, said first Velcro strip being disposed near said first side edge and said second Velcro strip being disposed near said second side edge.

8. The device of claim 5, further comprising at least one hook and loop type fastener strip attached to a top surface of said mattress, for removeably engaging said strip attached to said bottom surface of said fabric.

* * * * *

UNITED STATES PATENT AND TRADEMARK OFFICE

CERTIFICATE OF CORRECTION

PATENT NO. : 5,008,966

DATED : 4/23/91

INVENTOR(S) : Lepow

It is certified that error appears in the above-identified patent and that said Letters Patent is hereby corrected as shown below:

| | | |
|---|---|---|
| col. 01, line 15 | after "mattress" | insert --.-- |
| col. 01, line 43 | after "Velcro" | insert --.-- |
| col. 02, line 39 | delete "o" | insert --of-- |
| col. 03, line 17 | after "strips" | insert --14-- |
| col. 04, line 07 | delete "sao" | insert --so-- |

Signed and Sealed this

Twenty-fifth Day of May, 1993

*Attest:*

Michael K. Kirk

MICHAEL K. KIRK

*Attesting Officer*

*Acting Commissioner of Patents and Trademarks*